US009890985B2

(12) United States Patent
Bauriedl et al.

(10) Patent No.: US 9,890,985 B2
(45) Date of Patent: Feb. 13, 2018

(54) REFRIGERATION DEVICE COMPRISING AN ICE MAKER WITH DOUBLE STOPS

(71) Applicant: BSH BOSCH UND SIEMENS HAUSGERÄTE GMBH, München (DE)

(72) Inventors: Josef Bauriedl, Neunburg V.W. (DE); Gerald Schmidt, Gerstetten (DE)

(73) Assignee: BSH Hausgeraete GmbH, Munich (DE)

( * ) Notice: Subject to any disclaimer, the term of this patent is extended or adjusted under 35 U.S.C. 154(b) by 117 days.

(21) Appl. No.: 14/653,293

(22) PCT Filed: Dec. 13, 2013

(86) PCT No.: PCT/EP2013/076572
§ 371 (c)(1),
(2) Date: Jun. 18, 2015

(87) PCT Pub. No.: WO2014/095647
PCT Pub. Date: Jun. 26, 2014

(65) Prior Publication Data

US 2015/0362242 A1 Dec. 17, 2015

(30) Foreign Application Priority Data

Dec. 18, 2012 (DE) ..... 10 2012 223 631

(51) Int. Cl.
*F25C 1/22* (2006.01)
*F25C 1/04* (2006.01)
*F25C 5/06* (2006.01)

(52) U.S. Cl.
CPC ..... *F25C 1/04* (2013.01); *F25C 5/06* (2013.01); *F25C 2305/022* (2013.01)

(58) Field of Classification Search
CPC ..... F25C 5/06; F25C 2305/022
See application file for complete search history.

(56) References Cited

U.S. PATENT DOCUMENTS

| | | | | |
|---|---|---|---|---|
| 3,269,139 | A | 8/1966 | De Vincent | |
| 5,177,980 | A * | 1/1993 | Kawamoto | F25C 1/04 62/353 |
| 5,400,605 | A | 3/1995 | Jeong | |
| 7,204,092 | B2 * | 4/2007 | Azcarate Castrellon | F25C 5/06 62/353 |
| 8,726,686 | B2 * | 5/2014 | Yoon | F25C 1/04 62/345 |
| 8,800,316 | B2 * | 8/2014 | Lee | F25C 1/24 62/353 |
| 2002/0014087 | A1 | 2/2002 | Kwon | |

FOREIGN PATENT DOCUMENTS

EP 2151644 A1 2/2010

* cited by examiner

*Primary Examiner* — Orlando E Aviles Bosques
(74) *Attorney, Agent, or Firm* — Laurence A. Greenberg; Werner H. Stemer; Ralph E. Locher

(57) ABSTRACT

A refrigeration device has an ice maker with an ice cube tray that is rotatably mounted about a rotational axis. The ice maker includes two stops for limiting the rotational movement of the ice cube tray about the rotational axis.

13 Claims, 4 Drawing Sheets

REFRIGERATION DEVICE COMPRISING AN ICE MAKER WITH DOUBLE STOPS

BACKGROUND OF THE INVENTION

Field of the Invention

The invention relates to a refrigeration appliance having an ice maker, which features an ice cube tray supported in such a manner that it can be rotated about an axis of rotation.

Refrigeration appliances, in particular refrigeration appliances configured as domestic appliances, are known and are used for household management in domestic situations or in the catering sector, in order to store perishable food and/or beverages at defined temperatures.

In an ice maker of such a refrigeration appliance ice cubes formed in the ice cube tray are ejected in that the ice cube tray is twisted by means of a drive until the ice cube tray is upside down and the ice cubes drop out of the ice cube tray. This rotational movement of the ice cube tray is stopped by a stop from a defined position. As the ice tray is configured as flexible, contact with the stop causes the ice cube tray to twist, ultimately releasing the ice cubes from the ice cube tray. Gravity then causes them to drop down into an ice cube container arranged below the ice cube tray. The frequent deformation of the ice cube tray and the low ambient temperatures means that the ice cube tray is subject to a particular mechanical strain with the result that the ice cube tray has a short service life.

BRIEF SUMMARY OF THE INVENTION

It is therefore the object of the invention to provide a refrigeration appliance having an ice maker, which has a longer service life.

This object is achieved by the subject matter having the features as claimed in the independent claim. Advantageous developments are the subject matter of the dependent claims, the description and the drawings.

The present invention is based on the knowledge that the ageing of the ice cube tray due to elastic deformation can be reduced if the ice cube tray is deformed in a regular manner to empty out the ice cubes.

According to one aspect the inventive object is achieved by a refrigeration appliance, the ice maker of which has two stops to delimit a rotational movement of the ice cube tray. This has the technical advantage that the deformation for emptying the ice tray no longer exerts such a significant mechanical strain on the ice cube tray due to regularized deformation. The service life of the ice cube tray is therefore lengthened.

A refrigeration appliance refers in particular to a domestic appliance, in other words a refrigeration appliance used for household management in domestic situations or in the catering sector, which serves in particular to store food and/or beverages at defined temperatures, for example a refrigerator, a freezer cabinet, a combined refrigerator/freezer, a chest freezer or a wine chiller cabinet.

In one advantageous embodiment the ice cube tray can be twisted between a freezing position and an emptying position. This has the technical advantage that in the freezing position water can be frozen to make ice cubes in the ice cube tray and in the emptying position the ice cubes thus produced can be ejected from the ice cube tray by twisting the ice cube tray.

In a further advantageous embodiment the two stops delimit the rotational movement of the ice cube tray about the axis of rotation and thus determine the freezing position and the emptying position. This has the technical advantage that no further measuring means are required to detect the rotational position of the ice cube tray as it is moved between the freezing position and the emptying position, as the rotational movement is stopped by the stops. This results in a particularly simple structure.

In one advantageous embodiment at least one of the two stops has two opposing stop regions. This has the technical advantage that the ice maker has a particularly simple structure as each stop has a double function due to the two opposing stop regions.

In a further advantageous embodiment at least one stop region of one of the two stops is formed by an edge. This has the technical advantage that the stop region has a small surface and therefore frost cannot build up from the moisture in the air in the interior of the refrigeration appliance, possibly resulting in a build-up of ice as a result of the pressure produced by contact surfaces resting against the ice cube tray.

In a further advantageous embodiment the two stops are arranged at equal distances around the axis of rotation in the peripheral direction. This has the technical advantage that the two stops allow a rotational movement of the ice cube tray through for example 150° to 180°. This means that ice cubes form in a regular manner in the freezing position and reliable emptying of the ice cube tray is ensured in the emptying position.

In a further advantageous embodiment the two stops are arranged in an axisymmetrical manner in relation to the axis of rotation in the same position in its direction of extension. This has the technical advantage that the ice cube tray is subjected to strain by the two stops in a direction of extension at right angles to the rotational movement of the ice cube tray and not along its longitudinal axis, which extends in the direction of the axis of rotation and is relatively much more sensitive.

In a further advantageous embodiment the two stops are arranged to come into contact with end face contact segments of the ice cube tray. This has the technical advantage that the stops do not take up space in the width direction of the ice maker, thereby allowing a particularly compact structure to be achieved with the ice maker requiring little space.

In a further advantageous embodiment the end face contact segments are molded onto the ice cube tray. This has the technical advantage that the molded design of the contact segments means that stops do not have to be fitted. This simplifies manufacture.

In a further advantageous embodiment at least one of the two stops is made of plastic. This has the technical advantage that the stop or stops can be made of a material that is inexpensive and easy to process.

In a further advantageous embodiment at least one of the two stops is molded onto a frame of the ice maker. This has the technical advantage that the molded design of the stop or stops means that stops do not have to be fitted. This simplifies manufacture.

In a further advantageous embodiment the ice cube tray is configured as flexible. This has the technical advantage that ice cubes can be ejected from the ice cube tray by deforming the ice cube tray and no further devices are required to eject ice cubes.

In a further advantageous embodiment the ice cube tray can be twisted by a drive of the ice maker for rotating the ice cube tray. This has the technical advantage that the drive for rotating the ice cube tray has a double function, namely that of deforming the ice cube tray to eject the ice cubes in the ice cube tray as well as rotating the ice cube tray.

In a further advantageous embodiment the ice cube tray can be twisted about the axis of rotation. This has the technical advantage that the ice cube tray is twisted in a regular manner over its entire length in the axis of rotation, thereby ensuring that all the ice cubes in the ice cube tray are reliably ejected.

According to a second aspect the inventive object is achieved by an ice maker for such a refrigeration appliance. This has the technical advantage that that the deformation for emptying the ice tray no longer exerts such a significant mechanical strain on the ice cube tray due to regularized deformation. The service life of the ice cube tray is therefore lengthened.

BRIEF DESCRIPTION OF THE SEVERAL VIEWS OF THE DRAWING

Further exemplary embodiments are described with reference to the accompanying drawings, in which.

DESCRIPTION OF THE INVENTION

Figure 1:
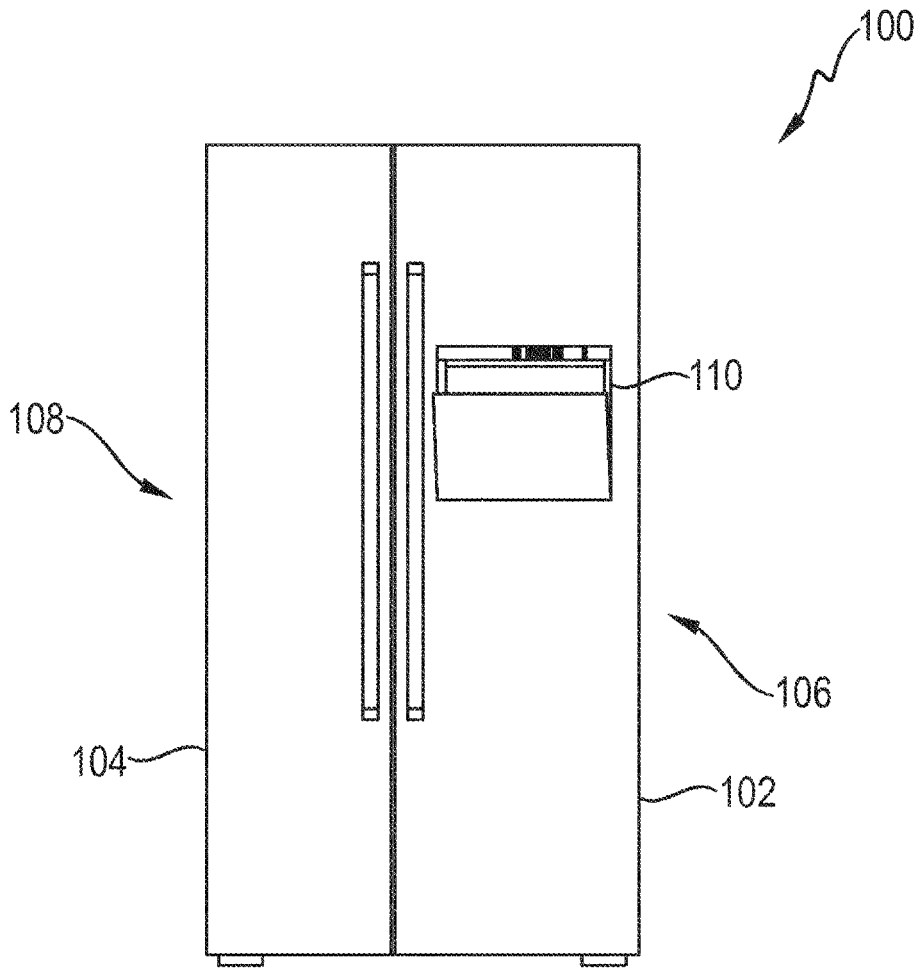
FIG. 1 shows a front view of a refrigeration appliance.

FIG. 1 shows an exemplary embodiment of a refrigeration appliance 100 in the form of a refrigerator, having a right refrigeration appliance door 102 and a left refrigeration appliance door 104 on its refrigeration appliance front face. The refrigerator serves for example to chill food and comprises a refrigerant circuit having an evaporator (not shown), a compressor (not shown), a condenser (not shown) and a throttle device (not shown).

The evaporator is configured as a heat exchanger, in which after expansion the liquid refrigerant is evaporated by absorbing heat from the medium to be cooled, in other words air in the interior of the refrigerator.

The compressor is a mechanically driven component, which takes in refrigerant vapor from the evaporator and ejects it to the condenser at a higher pressure.

The condenser is configured as a heat exchanger, in which after compression the evaporated refrigerant is condensed by emitting heat to an external cooling medium, in other words the ambient air.

The throttle device is an apparatus for constantly reducing the pressure by cross section reduction.

The refrigerant is a fluid used for heat transmission in the cold-generating system, which absorbs heat when the fluid is at low temperatures and low pressure and emits heat when the fluid is at a higher temperature and higher pressure, with state changes of the fluid generally being included.

The right refrigeration appliance door 102 can be used to open a right refrigeration compartment 106, which is configured as a freezer compartment in the present exemplary embodiment. The left refrigeration appliance door 104 can be used to open a left refrigeration compartment 108, which is configured as a chiller compartment in the present exemplary embodiment.

Arranged in the right refrigeration compartment 106 is an ice maker 110, which in the present exemplary embodiment prepares ice cubes from water and also supplies crushed ice. Ice cubes and/or crushed ice can be dispensed through the right refrigeration appliance door 102 at the refrigeration appliance front face without the right refrigeration appliance door 102 having to be opened.

Figure 2:
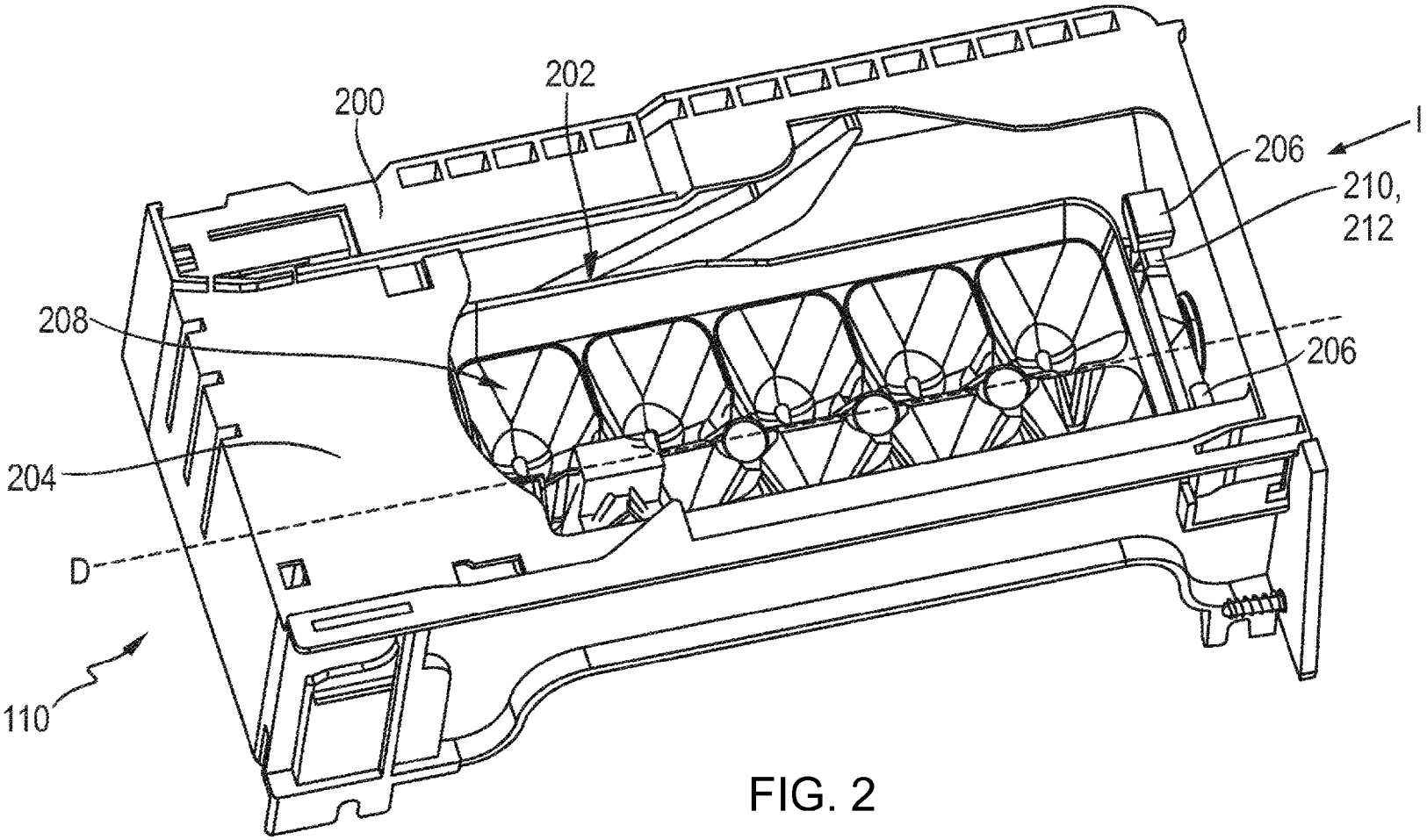
FIG. 2 shows a perspective representation of an ice maker.

FIG. 2 shows the ice maker 110.

In the present exemplary embodiment the ice maker 110 features a frame 200, made of plastic in the present exemplary embodiment. An ice cube tray 202 is supported in a rotatable manner on the frame 200. A drive 204 is provided to rotate the ice cube tray 202 about the axis of rotation D, being formed by an electric motor in the present exemplary embodiment.

In the present exemplary embodiment the ice cube tray 202 is made of a flexible plastic, for example by means of injection molding. The ice cube tray 202 has a plurality of depressions 208. The depressions 208 serve to hold liquid water which is then frozen to make ice cubes.

Ice cubes are then ejected from the depressions 208 in that the drive 204 twists the ice cube tray 202 through for example 150° to 180° so the ice cubes drop out of the ice cube tray 202.

To ensure reliable ejection of ice cubes from the depressions 208 of the ice cube tray 202, the ice cube tray 202, which is configured as flexible in the present exemplary embodiment, is twisted by the drive 204. In the present exemplary embodiment the ice cube tray 202 is twisted about the axis of rotation D. This brings about a minor deformation of the ice cube tray 202 so that ice cubes are released from the depressions 208 and drop down.

In order to bring about such twisting of the ice cube tray 202, the frame 200 in the present exemplary embodiment has two stops 206, which are made of plastic and molded onto the frame 200 in the present exemplary embodiment. Thus the frame is configured as a single piece with the two stops 206 in the present exemplary embodiment.

The two stops 206 delimit the rotational movement of the ice cube tray 202 about the axis of rotation D and thus define the freezing position I shown in FIG. 2, in which the depressions 208 of the ice cube tray 202 can be filled with water. In the present exemplary embodiment the two stops 206 are arranged in the same position 216 in the longitudinal extension of the axis of rotation D. Both stops 206 are in contact with the ice cube tray 202 here.

In the present exemplary embodiment the two stops 206 are each in contact with an end face contact segment 212 of the ice cube tray 202. In the present exemplary embodiment the two end face contact segments 212 are molded onto the ice cube tray 202. The ice cube tray 202 is thus configured as a single piece with the two end face contact segments 212.

The two stops 206 also define the emptying position (see FIG. 4) in the present exemplary embodiment, as described below.

Figure 3:
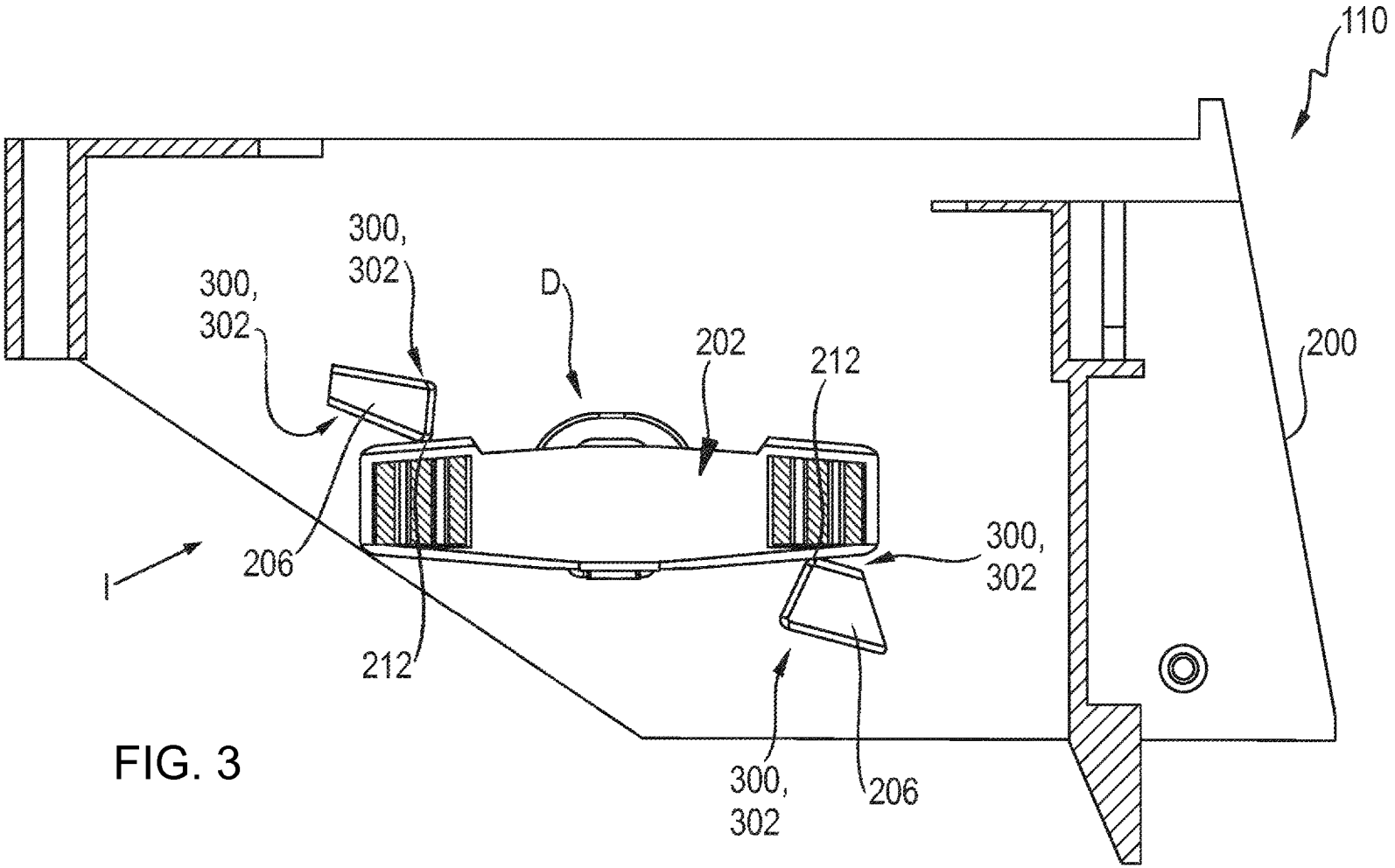
FIG. 3 shows an end face view of the ice maker with an ice cube tray in the freezing position.

FIG. 3 shows that both stops 206 are in contact with the ice cube tray 202 in the freezing position I.

FIG. 3 also shows that in the present exemplary embodiment the two stops 206 are offset by 180° from one another in the peripheral direction of the axis of rotation D. Therefore in the present exemplary embodiment they are arranged at equal distances in the peripheral direction of the axis of rotation D.

Each stop 206 has two stop regions 300, which are arranged opposite one another in the present exemplary embodiment. The stops 206 in the present exemplary embodiment are therefore configured as double stops. Therefore in the freezing position I in the present exemplary embodiment one of the two stop regions 300 of each stop 206 in each instance is in contact with the end face contact segments 212 of the ice cube tray 206. In the present exemplary embodiment the stop regions 208 are each formed by an edge 302, which in the present exemplary embodiment extends in the direction of the axis of rotation D. This reduces the size of the contact surface, which in turn reduces ice formation. Alternatively the stop regions 208 can also be configured as round or rounded, in order to reduce the contact surface.

Figure 4:
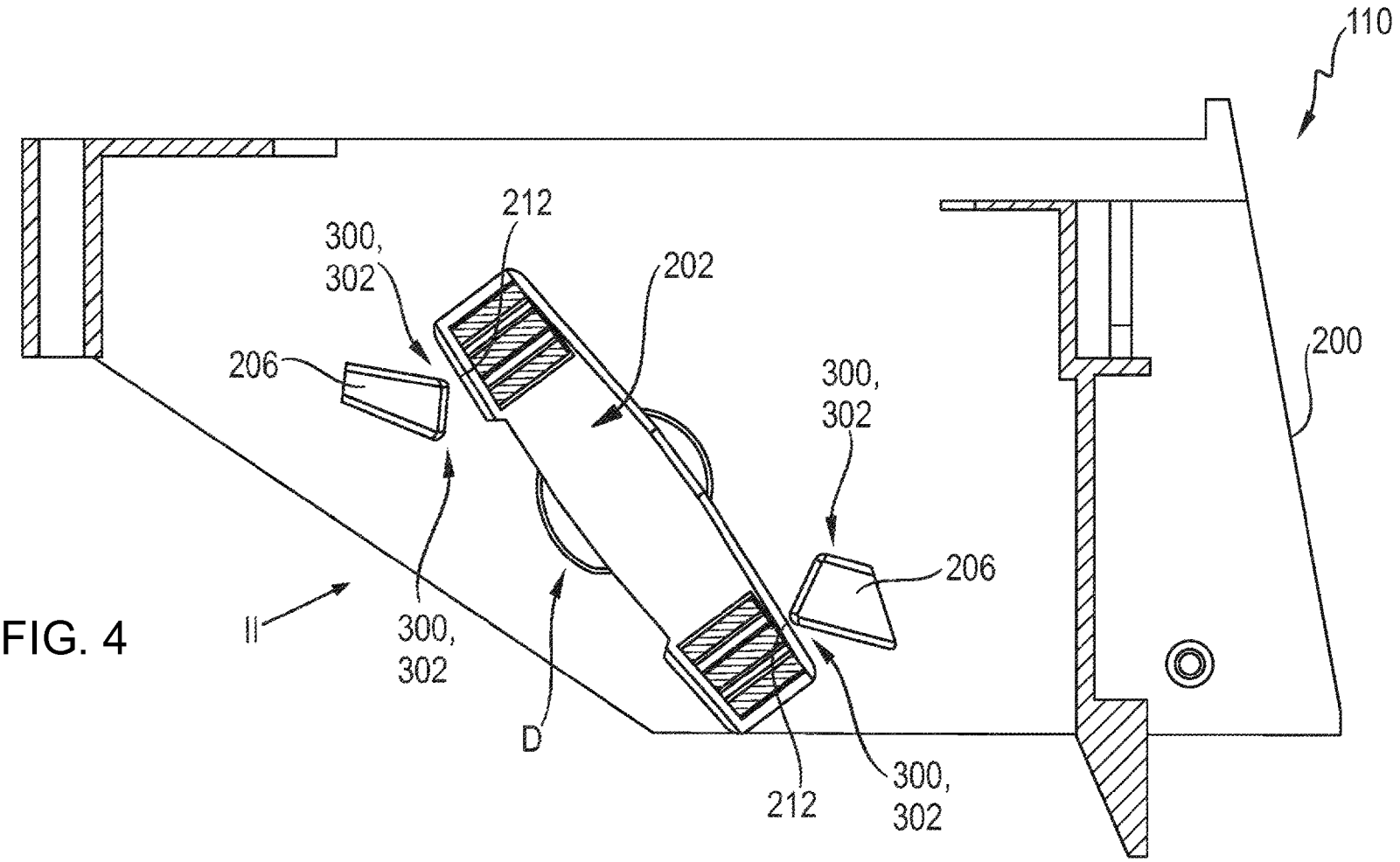
FIG. 4 shows the ice maker with the ice cube tray in an emptying position.

FIG. 4 shows the ice cube tray 202 in its emptying position II, to which it has been moved by rotation by the drive 204 about the axis of rotation D.

FIG. 4 also shows that the rotational movement is stopped by the two stops 206 when the emptying position II is reached, as the two other stop regions 300 of each stop 206 are then in contact with the end face contact segments 212 of the ice cube tray 206.

These stop regions 208 are also configured as edges 302 extending in the direction of the axis of rotation D. Alternatively said stop regions 208 can also be configured as round or rounded, in order to reduce the contact surface.

When it comes into contact with the edges 210, the ice cube tray 202 is made to twist about the axis of rotation D by the drive 204, as a result of which the elastically configured ice cube tray 202 is deformed to a minor degree such that ice cubes are released from the depressions 208.

The ice cube tray 202 is then moved back from the emptying position II to the freezing position I (see FIG. 3) by a rotational movement about the axis of rotation D. This rotational movement is in turn delimited by the stop regions 208. The ice cube tray 202 therefore returns to a zero position, in which regularly shaped ice cubes are formed in the depressions 208 of the ice cube tray 202. The stop regions 208 and the drive 204 interact here so that the ice cube tray 202 is twisted back again from the twisted state in the emptying position II (see FIG. 4) and thus regains its original shape, thereby ensuring that regularly shaped ice cubes are formed.

LIST OF REFERENCE CHARACTERS

100 Refrigeration appliance
102 Right refrigeration appliance door
104 Left refrigeration appliance door
106 Right refrigeration compartment
108 Left refrigeration compartment
110 Ice maker
200 Frame
202 Ice cube tray
204 Drive
206 Stop
208 Depression
210 Position
212 End face contact segment
300 Stop region
302 Edge
D Axis of rotation
I Freezing position
II Emptying position

The invention claimed is:

1. A refrigeration appliance, comprising:

an ice maker having an ice cube tray rotatably mounted about an axis of rotation;

said ice cube tray being mounted for pivoting between a freezing position and an emptying position;

said ice cube tray having end face contact segments formed thereon at opposite sides of said ice cube tray;

two stationary stops, each formed with two stop regions opposite one another, disposed to delimit a rotational movement of said ice cube tray about the axis of rotation; and said two stationary stops being disposed to terminate a rotation of said ice cube tray into the emptying position and to define the emptying position of said ice cube tray at one of said two stop regions;

wherein one of said stop regions of a respective said stationary stop contacts with one of said end face contact segments of the tray in the freezing position while said opposite stop region of said respective stationary stop contacts said end face contact segment of the opposite side in the emptying position.

2. The refrigeration appliance according to claim 1, wherein said two stationary stops are disposed to define the freezing position at one of said two stop regions and the emptying position at the other of said two stop regions by delimiting a rotational movement of said ice cube tray about the axis of rotation.

3. The refrigeration appliance according to claim 1, wherein at least one of said stop regions of one of said two stationary stops is formed by an edge.

4. The refrigeration appliance according to claim 1, wherein said two stationary stops are disposed at equal distances around the axis of rotation in a circumferential direction.

5. The refrigeration appliance according to claim 1, wherein said two stationary stops are axisymmetrically disposed in relation to the axis of rotation in equal positions in a radial direction thereof.

6. The refrigeration appliance according to claim 1, wherein at least one of said two stationary stops is made of plastic.

7. The refrigeration appliance according to claim 1, wherein said end face contact segments are molded onto said ice cube tray.

8. The refrigeration appliance according to claim 1, wherein said ice maker includes a frame, and at least one of said two stationary stops is molded onto said frame of said ice maker.

9. The refrigeration appliance according to claim 1, wherein said ice cube tray is flexibly deformable.

10. The refrigeration appliance according to claim 9, wherein said ice maker includes a drive configured for rotating said ice cube tray.

11. The refrigeration appliance according to claim 10, wherein said ice cube tray is twistable about the axis of rotation.

12. An ice maker for a refrigeration appliance, the ice maker comprising:

an ice cube tray rotatably mounted about an axis of rotation;

said ice cube tray being mounted for pivoting between a freezing position and an emptying position;

said ice cube tray having end face contact segments formed thereon at opposite sides of said ice cube tray;

two stationary stops, each formed with two stop regions opposite one another; disposed to delimit a rotational movement of said ice cube tray about the axis of rotation; and said two stationary stops disposed to terminate a rotation of said ice cube tray into the emptying position and to define the emptying position of said ice cube tray at one of said two stop regions:

wherein one of said stop regions of a respective said stationary stop contacts with one of said end face contact segments of the tray in the freezing position while said opposite stop region of said respective stationary stop contacts said end face contact segment of the opposite side in the emptying position.

13. The ice maker according to claim 12, wherein said two stationary stops are disposed to determine the freezing position and the emptying position by delimiting a rotational movement of said ice cube tray about the axis of rotation.

* * * * *